US005318128A

United States Patent [19]

Johnson et al.

[11] Patent Number: 5,318,128

[45] Date of Patent: Jun. 7, 1994

[54] METHOD AND APPARATUS FOR CLEANING WELLBORE PERFORATIONS

[75] Inventors: Michael H. Johnson, Spring; Bennett M. Richard, Kingwood, both of Tex.

[73] Assignee: Baker Hughes Incorporated, Houston, Tex.

[21] Appl. No.: 987,609

[22] Filed: Dec. 9, 1992

[51] Int. Cl.[5] ..... E21B 37/00

[52] U.S. Cl. ..... 166/312

[58] Field of Search ..... 166/311, 312, 222

[56] References Cited

U.S. PATENT DOCUMENTS 2,290,141 7/1942 Burt ..... 166/312
4,519,456 5/1985 Cochran ..... 166/312
5,033,545 7/1991 Sudol ..... 166/312

OTHER PUBLICATIONS

The Technology of Artifical Lift Methods-vol. 2b, Chapter 6, "Jet Pumping" by Hal Petrie, date unknown.

*Primary Examiner*—William P. Neuder
*Attorney, Agent, or Firm*—Rosenblatt & Associates

[57] ABSTRACT

An apparatus and method are disclosed for removing debris from a recently perforated formation. A vacuum source, such as a subsurface jet pump is employed, coupled with a sealing arrangement to isolate a portion of the recently perforated formation. The vacuum device increases the velocity of the formation fluids to enable them to entrain the debris and bring it to the surface.

1 Claim, 1 Drawing Sheet

METHOD AND APPARATUS FOR CLEANING WELLBORE PERFORATIONS

FIELD OF THE INVENTION

The field of this invention relates to perforation of formations and a method and apparatus for removing debris following the perforation process.

BACKGROUND OF THE INVENTION

Perforating guns are well known in the oil and gas field. They are used to perforate a formation in a wellbore to stimulate production of hydrocarbons into the wellbore and ultimately to the surface. The typical process involves lowering a perforating gun on a tubing string and isolating the annulus between the tubing string and the wellbore with a packer. The gun may also be lowered into position by a wireline. The perforating gun is set through a variety of means. The explosive charge impinges on the wellbore and creates the perforations through which it is hoped the hydrocarbons will flow. The setting off of the perforating gun creates debris in the form of portions of the formation being displaced through the velocity of the explosive charge set off in the gun, as well as some of the explosive charge itself. It is desirable to get rid of the debris prior to beginning regular production from the wellbore. If the debris is not adequately removed, it can foul the recently created perforations and impede the removal of hydrocarbons from the formation to the surface through the wellbore. The presence of debris can also impede the insertion of screens and the performance of a commonly known procedure called "gravel packing."

In the past, various techniques have been used to remove such debris. One known technique is to create an underbalance adjacent the recently perforated formation. An underbalance is typically created by injection of a gas to displace some of the fluid in the wellbore to reduce the pressure adjacent the formation so that when flow is allowed to occur, the pressure adjacent the wellbore is reduced and formation fluids tend to flow into the wellbore rather than the reverse. Regardless whether circulation or reverse circulation is used, whether in conjunction with creating an underbalance or without, a potential problem of fluid losses into the formation exists. Additional problems exist if the velocity of the circulated fluid is insufficient to entrain some of the debris which is desired to be removed. In deviated wellbores the perforation may be over a long distance and existing equipment may be insufficient to create zones of sufficient velocity over the length of the perforation so as to be able to entrain the debris for its removal. Further problems can occur when, despite the fact that the circulation or reverse circulation is of sufficient velocity, there are pockets of low flow or no flow adjacent the recently perforated formation. This can result in erratic performance with regard to debris removal leaving some portions of the recently perforated formation cleared of debris while others are covered with debris. What has been lacking in the past is an ability to isolate small portions of the recently perforated formation and ensure sufficient velocities in those smaller portions to effectuate a more thorough removal of debris from those zones. What is also lacking from prior methods is a way to restrict or reduce, if not eliminate, the loss of fluids into the formation which can result from various operations typically performed after perforation such as bullheading.

To address these needs, the apparatus and method of the present invention have been developed so that small portions of the recently perforated zone can be isolated. Debris can be efficiently removed from these isolated zones through the use of a vacuum source which creates the requisite velocity to entrain the debris and bring it to the surface.

Jet pumps have been used in downhole applications in the past. Jet pumps achieve pumping action by means of momentum transfer between the power fluid and the produced fluid. In typical prior applications, the power fluid enters the top of the pump from the pump tubing and passes through a nozzle where virtually all of the total pressure of the power fluid is converted to a velocity head. The jet from the nozzle discharges into the production inlet chamber, which is in fluid communication with the wellbore. The production fluid is entrained by the power fluid and the combined fluids enter the throat of the pump.

The throat, which is always of a larger diameter than the nozzle, is where the mixing of the power fluid and production fluid takes place. The power fluid losses momentum and energy and the production fluid gains momentum and energy. The mixed fluid exiting the throat has sufficient total head to flow against the production return column gradient. Much of the total head is still in the form of a velocity head. The final working section of a jet pump is a shaped diffuser section of expanding area which converts the velocity head into a static pressure head greater than the static column head to allow flow to the surface.

Jet pumps have the advantage of not having closely fitting reciprocating parts, which allow them to tolerate power and production fluids of poorer quality than those normally required for reasonable life in a subsurface hydraulic pump. Jet pumps also have low profiles which make them adaptable for use in wellbores. Jet pumps can move higher volumes of liquid or gas as compared to conventional subsurface hydraulic pumps located in the same size tubing.

Jet pumps have been used in some high volume gassy or dirty wells. Such pumps are not applicable to all wells and are limited by their characteristics which require a relatively high suction pressure to avoid cavitation, and relatively low mechanical efficiency which requires higher input horsepower than a conventional hydraulic pump. Typically, such pumps have been used to enhance production from wells which need a downhole power assist for the hydrocarbons to be produced at the surface.

SUMMARY OF THE INVENTION

An apparatus and method are disclosed for removing debris from a recently perforated formation. A vacuum source, such as a subsurface jet pump is employed, coupled with a sealing arrangement to isolate a portion of the recently perforated formation. The vacuum device increases the velocity of the formation fluids to enable them to entrain the debris and bring it to the surface.

DETAILED DESCRIPTION OF THE PREFERRED EMBODIMENT

Figure 1:
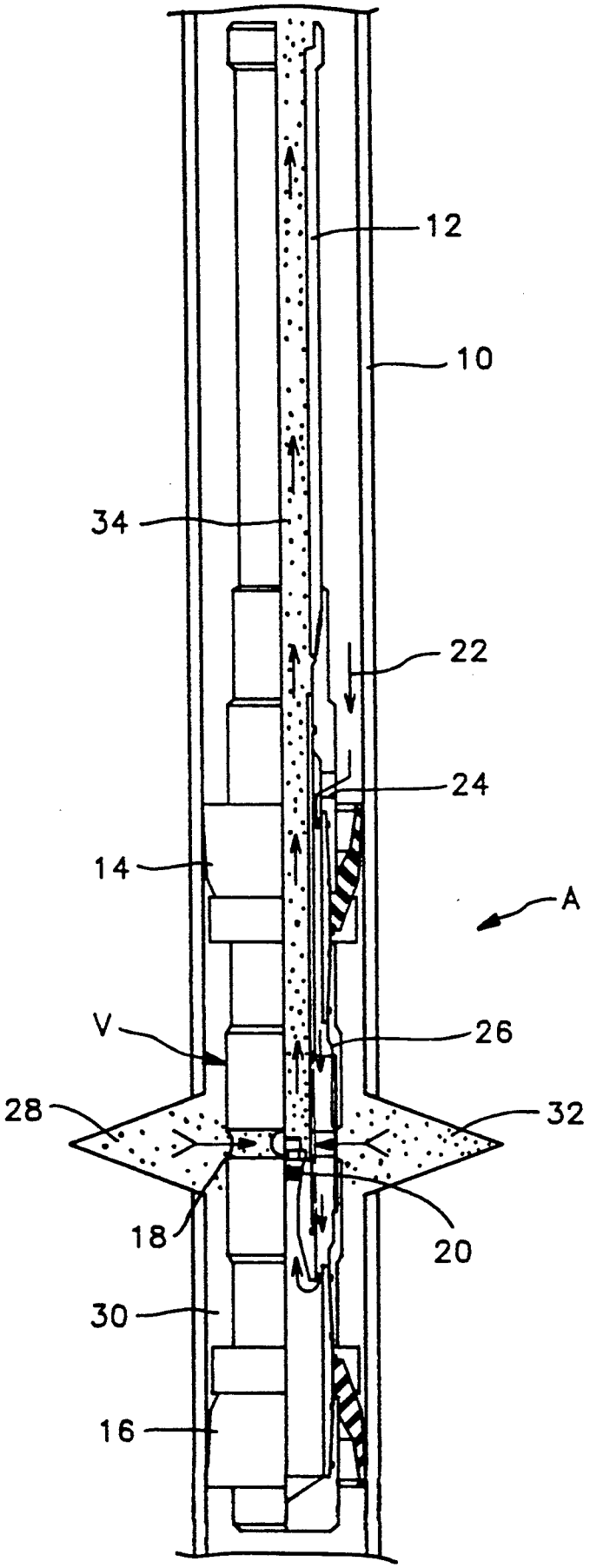
FIG. 1 is a sectional elevational view of the apparatus of the present invention.

The apparatus A is shown in FIG. 1. A wellbore or casing 10 contains a tubing string 12. A plurality of sealing members 14 and 16 are spaced apart on tubing 12. One or more isolated zones can be employed with cup shaped seals 14 and 16 are illustrated in the preferred embodiment, however, other types of sealing arrangements such as packers can be used without departing from the spirit of the invention. Connected to the tubing string 12 in the general area of seals 14 and 16, is vacuum means V. In the preferred embodiment, vacuum means V is a jet pump having a formation fluid inlet 18. Inlet 18 can be a slot or series of slots, a screen, or one or more openings sized to allow solids to pass. In the preferred embodiment, the openings 18 are sized to prevent clogging around the area of nozzle 20. The motive fluid for the jet pump V is represented by arrow 22 and is introduced into the wellbore or casing from the surface. The motive fluid enters through opening 24 and flows down a passageway 26 and into nozzle 20. The energy of the fluid exiting the nozzle 20 draws in formation fluid (schematically represented by arrow 28.

With only a short segment of the formation exposed between sealing members 14 and 16, the action of the jet pump V tends to reduce pressure in zone 30 between sealing members 14 and 16. The reduced pressure accelerates the formation fluids indicated by arrow 28 and allows debris 32 to be entrained with the fluids 28. The mixture of the debris 32 and the fluids 28 with the motive fluid indicated by arrow 22 exists through the tubing 12 through passageway 34. The fluid in passageway 34 has sufficient head due to the transmission of energy from nozzle 20 to overcome the pre-existing column of liquid in passageway 34 going back to the surface.

Those skilled in the art will appreciate that the tubing string 12 can be moved within the wellbore to repeat the process over small increments of distance along the wellbore. Prior to this procedure, a perforating gun (not shown) is run into the wellbore on a previous trip in order to perforate into the formation. Thereafter, the perforating gun can be removed and the jet pump be installed on a separate trip into the wellbore. It is also within the scope of the invention to mount the perforating gun and the jet pump in series to allow perforating and debris removal in one trip. However, the preferred embodiment is illustrated in FIG. 1.

The apparatus and method shown in FIG. 1 offers many advantages over known methods of removing debris. The vacuum created by the jet pump V significantly increases the velocity of the formation fluid in the isolated zone. By virtue of using the jet pump V in combination with closely mounted sealing members 14 and 16, debris removal can be efficiently accomplished due to the improved entrainment resulting from the velocity increase achieved by the vacuum created from the jet pump V. The sealing members 14 and 16 can be placed as close as a few inches apart or further apart, such as a few feet or more, as desired. The duration of application of vacuum to a specific zone within the formation can be varied depending upon the degree of debris removal required and the capacity of surface facilities to handle the requisite circulating fluids.

Should the performance of a jet pump V become impaired due to blockage at openings 18, the direction of flow in passages 26 and 34 can be reversed in essence putting a reverse flow out of openings 18 to dislodge any solids that may be obstructing such openings 18.

The foregoing disclosure and description of the invention are illustrative and explanatory thereof, and various changes in the size, shape and materials, as well as in the details of the illustrated construction, may be made without departing from the spirit of the invention.

We claim:

1. A method for removing debris after a formation is perforated in a wellbore comprising:

isolating at least one portion of the formation in the wellbore with a tool;

accomplishing said isolating step with a plurality of cup seals;

applying a vacuum to the portion of the wellbore that is isolated;

accomplishing said vacuum with a jet pump;

allowing formation fluids to flow through the tool to the surface;

increasing the velocity of the formation fluids in the isolated portion of the wellbore by virtue of said applied vacuum;

entraining the debris in said isolated portion of the wellbore due at least in part to said velocity increase;

removing the fluid and entrained debris from the wellbore; and back washing a screen to remove accumulated debris.

* * * * *